United States Patent [19]

Wiedemann

[11] 4,390,609

[45] Jun. 28, 1983

[54] ELECTROPHOTOGRAPHIC RECORDING MATERIAL WITH ABRASION RESISTANT OVERCOAT

[75] Inventor: Wolfgang Wiedemann, Geisenheim, Fed. Rep. of Germany

[73] Assignee: Hoechst Aktiengesellschaft, Frankfurt am Main, Fed. Rep. of Germany

[21] Appl. No.: 291,050

[22] Filed: Aug. 7, 1981

[30] Foreign Application Priority Data

Aug. 30, 1980 [DE] Fed. Rep. of Germany ..... 3032774

[51] Int. Cl.[3] ..... G03G 5/14

[52] U.S. Cl. ..... 430/58; 430/66; 430/67

[58] Field of Search ..... 430/56, 58, 59, 66, 430/67, 89, 96

[56] References Cited

U.S. PATENT DOCUMENTS

| | | | |
|---|---|---|---|
| 2,901,348 | 8/1959 | Dessauer et al. | 430/64 X |
| 3,140,174 | 7/1964 | Clark . | |
| 3,810,759 | 5/1974 | Stahr et al. | 430/56 X |
| 3,870,516 | 3/1975 | Smith et al. | 430/96 X |
| 3,894,868 | 7/1975 | Regensburger | 430/96 X |
| 4,203,764 | 5/1980 | Tosaka et al. | 430/67 |
| 4,251,612 | 2/1981 | Chu et al. | 430/59 |

FOREIGN PATENT DOCUMENTS

| | | | |
|---|---|---|---|
| 639318 | 4/1962 | Canada | 430/89 |
| 49-135633 | 12/1974 | Japan | 430/67 |
| 50-50929 | 5/1975 | Japan | 430/58 |
| 54-3538 | 1/1979 | Japan | 430/67 |
| 1578960 | 11/1980 | United Kingdom . | |
| 1587312 | 4/1981 | United Kingdom . | |

OTHER PUBLICATIONS

Xerox Disclosure Journal, Band 5, Nr. 2, (Mar.-Apr., 1980).

Research Disclosure, Nr. 109, Article No. 10928, (May, 1973).

*Primary Examiner*—Roland E. Martin, Jr.

*Attorney, Agent, or Firm*—Schwartz, Jeffery, Schwaab, Mack, Blumenthal & Koch

[57] ABSTRACT

An electrophotographic recording material comprising an electrically conductive support, an optional insulating intermediate layer, at least one photoconductive layer comprising a charge carrier generating compound and a charge transporting compound, and a protective transparent cover layer made from a surface abrasion resistant binder composed of a polyurethane resin, polycarbonate resin, phenoxy resin, polyacrylate or polymethacrylate resin, polyurethane formed from a two-component system comprising a polyisocyanate and a hydroxyl group containing polyester or polyether, a polyisocyanate and a hydroxyl group containing acrylic or epoxy resin, polyurethane formed from a one-component system comprising a polyisocyanate prepolymer, or a polyisocyanate having temporarily masked isocyanate groups.

7 Claims, 4 Drawing Figures

ELECTROPHOTOGRAPHIC RECORDING MATERIAL WITH ABRASION RESISTANT OVERCOAT

BACKGROUND OF THE INVENTION

This invention relates to an electrophotographic recording material comprising an electrically conductive support; an optional insulating interlayer; a photoconductive layer comprising at least one charge carrier generating compound and at least one charge transporting compound; and a protective transparent covering layer.

In the electrophotographic process described in U.S. Pat. No. 2,297,691 which is now widely used for preparing electrophotographic copies, thorough cleaning of the photoconductor layer is always required after the toner image developed by a dry method on the photoconductor layer has been transferred to the support of the copy. Usually, cleaning is effected by brushing or wiping the layer with suitable brushes or cloths. In copying machines which utilize fluid developers, the effect of mechanical cleaning is frequently enhanced by also using cleaning fluid. In addition to these cleaning operations, the photoconductive layer is also exposed to other influences which may damage it. For example, it is subject to the action of the dry developer and of the developer station (counter-voltage) and during fluid development, additionally to the action of the developer fluid. It is also exposed to ionized air generated in the charging station. It is known that the requisite cleaning procedures and other influences mentioned result in deterioration of the photoconductor layer, or even in mechanical damage thereto, and thus reduce the service life of the photoconductor.

Recording materials comprising a photoconductive layer comprising at least one layer comprising a charge carrier generating compound and a charge transporting compound are known. For example, German Auslegeschrift 2,314,051 discloses use of highly sensitive, organic photoconductor layers on conductive support films or support bands because of their high elasticity.

In particular, very highly sensitive photoconductor systems, such as those disclosed in German Offenlegungsschrift 2,734,288, can be used in the form of endless bands which, because of their high flexibility, can be passed over guide rollers of relatively small diameter.

Patents such as U.S. Pat. No. 2,901,348, U.S. Pat. No. 4,148,637 and German Offenlegungsschrift 2,452,623 disclose protecting photoconductor layers with an additional covering layer of inorganic or organic materials. A disadvantage of such systems is that they are used either on less flexible layers which are composed of or contain selenium, or on generally less sensitive organic photoconductor systems. Moreover, silane couplers, such as chlorosilane, must be added to these covering layers to improve their stability, or the covering layers additionally contain a photoconductive organic compound.

SUMMARY OF THE INVENTION

It is the object of the present invention to provide a new electrophotographic recording material.

A further object of the present invention is to provide an electrophotographic recording material which is transparent and highly sensitive.

Another object of the present invention is to provide an electrophotographic recording material having a protective covering layer over the photosensitive material.

A still further object of the present invention is to provide an electrophotographic recording material with improved abrasion resistance.

It is also an object of the present invention to provide an electrophotographic recording material which can be developed by a dry method or by a fluid developing recess.

An additional object of the present invention is to provide an electrophotographic recording material which has a readily cleanable surface and which resists deterioration during cleaning.

Yet another object of the present invention is to provide an electrophotographic recording material which resists both mechanical and chemical deterioration.

A further object of the present invention is to provide an electrophotographic recording material with a reduced susceptibility to damage from exposure to ionized air.

Another object of the present invention is to provide an electrophotographic recording material having a long service life.

A still further object of the present invention is to provide an electrophotographic recording material which can be configured either as a flexible endless band or as a rigid drum.

It is also an object of the present invention to provide a multi-layer electrophotographic recording material wherein the various layers adhere well to each other.

Another object of the present invention is to provide an electrophotographic recording material which can effectively utilize organic photoconductive materials.

These and other objects are achieved by providing an electrophotographic recording material wherein the covering layer comprises an abrasion resistant organic binder selected from the group consisting of polyurethane resin, polycarbonate resin, phenoxy resin, polyacrylate or polymethacrylate resin, polyurethane formed from a two-component system comprising a polyisocyanate and a hydroxyl group containing polyester or polyether, a polyisocyanate and a hydroxyl group containing acrylic or epoxy resin, polyurethane formed from a one-component system comprising a polyisocyanate prepolymer, or comprising a polyisocyanate having temporarily masked isocyanate groups. The binders may be non-crosslinking, crosslinkable by subsequent treatment or self-crosslinking By means of the invention, electrophotographic recording materials are provided which, while virtually maintaining the photosensitivity of the photoconductor, markedly improve the abrasion resistance and the service life.

The abrasion-resistant covering layer can be applied by coating, dipping or (electrostatic) spraying, with subsequent drying and, if appropriate, curing.

Due to the increase in abrasion resistance, and hence in service life, multi-layer arrangements can be employed more profitably, not only on flexible conductive supports, but also on drums.

BRIEF DESCRIPTION OF THE DRAWINGS

The invention will be further explained with reference to the accompanying drawings wherein like reference numerals identify like parts throughout.

DETAILED DESCRIPTION OF PREFERRED EMBODIMENTS

Figure 1:
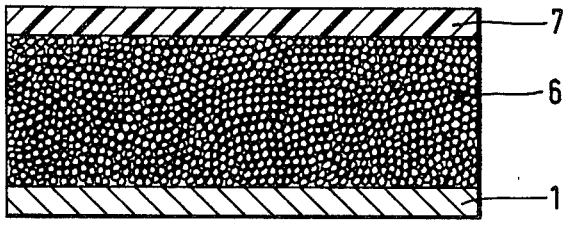
FIG. 1 is a schematic sectional view of an electrophotographic recording material according to the invention comprising a single photoconductive layer.
Figure 2:
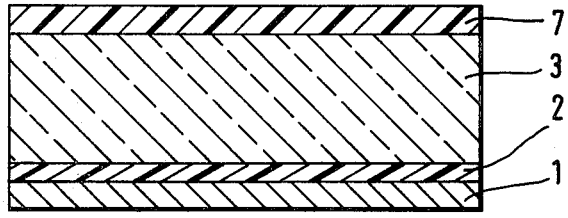
FIG. 2 is a schematic sectional view of an alternate embodiment of electrophotographic recording material comprising a two layer photoconductor arrangement.
Figure 3:
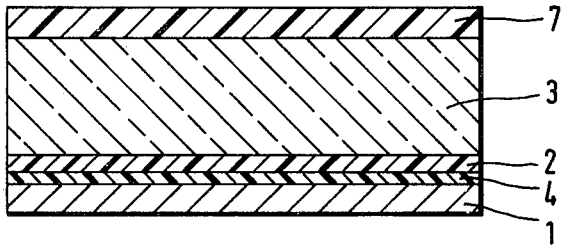
FIG. 3 is a schematic sectional view of a third electrophotographic recording material which is provided with an insulating interlayer.

The electrophotographic recording material according to the invention is schematically represented by the attached FIGS. 1 to 4. As illustrated in FIG. 1, the photoconductive layer can take the form of a single layer, as indicated by reference numeral 6. It can also take the form of a two layer arrangement as depicted in FIGS. 2 and 3, comprising a layer 2 containing compounds which generate charge carriers and a layer 3 containing compounds which transport charges. In general, the two layer arrangement is preferred. The conductive support is identified by reference numeral 1 in each case. An insulting interlayer is designated by reference numeral 4. Reference numeral 5 identifies a layer containing a charge carrier generating compound in dispersion. The numeral 7 indicates a protective covering layer according to the invention.

Examples of suitable conductive supports include aluminum foil, and polyester films which may be transparent and on which aluminum has been vapor-deposited or which are laminated to aluminum. Any other support which has been rendered sufficiently conductive can also be used.

The insulating interlayer may comprise an alumina layer which may be produced thermally, anodically (electrochemically) or chemically. Alternately, the insulating layer can also be composed of organic materials. Different natural resin binders or synthetic resin binders which have good adhesion to an aluminum or other metal surface and suffer little incipient dissolution when further layers are subsequently applied, may be used. Suitable resins include polyamide resins, polyvinylphosphonic acid, polyurethanes, polyester resins, or specifically alkali-soluble binders such as styrene/-maleic anhydride copolymers. The thickness of organic interlayers of this type can be up to 5 μm. When an alumina layer is used, the thickness of the layer lies in most cases in the range from 0.01–1 μm.

The layers 2 and 5 are charge carrier generating layers. The compounds which are used here and generate charge carriers determine, to a particular degree, spectral light-sensitivity of the photoconductive system. Many different types of dyestuffs can be employed as charge carrier generating substances. Useful charge carrier generating substances include perylene-3,4,9,10-tetracarboxylic acid anhydride or perylene-3,4,9,10-tetracarboxylic acid imide derivatives according to German Offenlegungsschrift 22 37 539; N,N'-bis-(3-methoxy propyl)-3,4,9,10-perylene tetracarboxylic acid imide according to German Pat. No. 22 32 513; polynuclear quinones according to German Offenlegungsschrift 22 37 678; cis- or transperinones according to German Offenlegungsschrift 22 39 923; thioindigo dyestuffs according to German Offenlegungsschrift 22 37 680; quinacridones according to German Offenlegungsschrift 22 37 679; condensation products of benzo-4,10-thioxanthene-3,1'-dicarboxylic acid anhydride and amines according to German Offenlegungsschrift 23 55 075; phthalocyanine derivatives according to German Offenlegungsschrift 22 39 924; and dyestuffs which in accordance with the procedure described in *Bull. Chem. Soc. Japan,* Vol. 25, pp. 411–413 (1952) are produced by condensation from perylene-3,4,9,10-tetracarboxylic acid anhydride and o-phenylene diamine or 1,8-diaminophthaline, according to German Offenlegungsschrift 23 14 051. Furthermore, dyestuffs according to German Offenlegungsschriften 22 46 255, 23 53 639 and 23 56 370 may also be used.

As already mentioned above, thin layers of inorganic materials which generate charge carriers are also suitable. Such layers may be produced by vapor-depositing selenium, doped selenium, cadmium sulfide, and similar photosensitive materials.

A homogeneous, closely packed layer 2 is preferably applied by vapor-deposition in vacuo. Advantageously, the thickness of the layer 2 will range between about 0.005 and 3 μm. The adhesive strength and homogeneity of the vapor-deposited layer are particularly favorable within this range.

Figure 4:
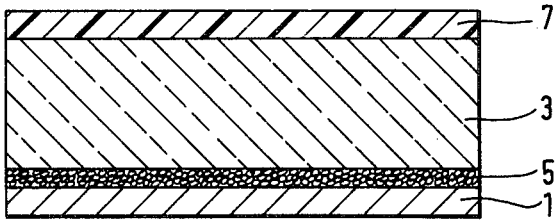
FIG. 4 is a schematic sectional view of an electrophotographic recording material embodiment including a layer comprising a dispersed charge-generating compound.

In combination with the interlayer, or as a substitute for the interlayer, homogeneous, well covering dye layers having thicknesses on the order of magnitude of 0.1 to 3 μm can also be prepared by milling or grinding the dye with a binder, especially with highly viscous cellulose nitrates and/or crosslinking binder systems such as acrylic resins which can be crosslinked by polyisocyanate, or lacquers formed from polyisocyanates and hydroxyl group containing polyesters or polyethers. The resulting dye dispersions 5 are subsequently applied to the support 1 as shown in FIG. 4. Organic compounds which have an extended $\pi$-electron system are most suitable as the charge transport material in layers 3 or 6. These include, in particular, monomeric aromatic or heterocyclic compounds, such as those which contain at least one dialkylamino group or two alkoxy groups. The oxadiaxole derivatives mentioned in German Pat. No. 1,058,836 have proved suitable, particularly 2,5-bis-(p-diethylaminophenyl)-1,3,4-oxadiazole. Further examples of suitable monomeric electron donor compounds are triphenylamine derivatives; highly condensed aromatic compounds such as pyrene; benzo-condensed heterocyclic compounds; pyrazoline derivatives or imidazole derivatives as disclosed in German Pat. Nos. 1,060,714, and 1,106,599; triazole derivatives, thiadiazole derivatives and especially oxazole derivatives, for example 2-phenyl-4-(2-chlorophenyl)-5-(4-diethylamino)-oxazole, as disclosed in German Pat. Nos. 1,060,260, 1,299,296 and 1,120,875.

The charge-transport layer 3 has virtually no photosensitivity in the visible range (420–750 nm). Preferably, it is composed of a mixture of an electron donor compound with a resin binder, if a negative charge is to be obtained.

Layer 3 is preferably transparent. It is also possible, however, that in a case such as a transparent conductive support, it would not need to be transparent. The layer has a high electrical resistance ($\geqq 10^{12}\ \Omega$), and in the dark it prevents leakage or discharge of the electrostatic charge. When exposed to light, it transports the charges generated in the organic dye layer.

In addition to the previously described compounds which generate and transport charge carriers, the added binder affects both the mechanical properties, such as abrasion resistance, flexibility, film-forming, etc., and to a certain extent the electrophotographic properties, such as photosensitivity, residual charge and cyclical behavior.

The binders employed are film-forming compounds, such as polyester resins, polyvinyl chloride/polyvinyl acetate copolymers, styrene/maleic anhydride copolymers, polycarbonates, silicone resins, polyurethanes, epoxy resins, acrylates, polyvinyl acetals, polystyrenes, cellulose derivatives such as cellulose acetobutyrates, and the like. Moreover, subsequently crosslinkable binder systems such as DD lacquers (for example Desmophen/Demodur®, Bayer AG), acrylate resins which can be crosslinked by polyisocyanate, melamine resins, unsaturated polyester resins and the like, may be used successfully.

Because of the combined advantages (high photosensitivity, flash sensitivity, high flexibility), the use of cellulose nitrates, particularly the high-viscosity types, is preferred.

The mixing ratio of the charge transporting compound to the binder may vary. However, relatively strict limits are posed by the requirement for maximum photosensitivity, i.e., the greatest possible proportion of charge transporting compound, and the simultaneous requirement that crystallization of the charge transporting compound be prevented and that the flexibility of the layer be increased, i.e., the greatest possible proportion of binder. In general, a mixing ratio of about 1:1 parts by weight has proved to be preferable, but ratios between 4:1 and 1:2 are also suitable. The thickness of the phototransport layer 3 or 6 lies preferably between about 3 and about 20 μm.

Conventional additives may be added to the layer including flow agents such as silicone oils; wetting agents, particularly non-ionic substances; and plasticizers of varying composition such as those based on chlorinated hydrocarbons or on phthalates. If desired, sensitizers and/or acceptors can also be included as additives to the charge transport layer, but only to such an extent that the optical transparency of the charge transport layer is not significantly impaired.

In conjunction with the covering layer according to the invention, additions of micronized organic or inorganic powders in quantities of up to about 30% by weight, preferably about 10% by weight, have also proved advantageous. In this way, the abrasion resistance is improved to a certain extent, and, the adhesion of the subsequently applied covering layer is markedly improved by the rougher, dull surface. Preferred organic powders include micronized polypropylene waxes, polyethylene waxes, polyamide waxes or powders of polytetrafluoroethylene or polyvinylidene fluoride. Useful inorganic powders include those based on silica.

Either non-crosslinking binders, subsequently crosslinkable binders, or self-crosslinking binders can be used as the organic binders resistant to surface abrasion.

Polyurethane resins, polycarbonate resins, phenoxy resins, polyacrylates or polymethacrylates may be mentioned as non-crosslinking organic binders. Such resins can be used individually or in mixtures. Preferably, aromatic or aliphatic, non-reactive, linear polyurethanes or a binder obtained from dihydroxydiphenylalkane and phosgene are used. Polysulfones, polyphenylene oxides and polyvinyl acetates are also suitable.

Suitable subsequently crosslinkable binders include two-component systems comprising saturated or unsaturated polyesters or polyethers containing hydroxyl groups which crosslink with an aliphatic and/or aromatic polyisocyanate resin, or acrylic or expoxy resins which contain hydroxyl groups and crosslink with polyisocyanate. Useful one-component systems include moisture-curing polyisocyanate prepolymers, air-drying polyurethane resins (polyurethane alkyd resins), or temporarily masked polyisocyanates having isocyanate groups capable of crosslinking on heating.

Suitable self-crosslinking binders, which optionally may be heat-curable, include pure acrylic resins, preferably aqueous dispersions; or heat-curable acrylic resins which crosslink by external action, if desired with an addition of melamine resin. Epoxy resin systems with hardeners, as well as unsaturated heat-curing polyester resins with or without an accelerator, can also be used successfully.

It has also proved to be advantageous for the covering layer to comprise a self-crosslinking polyisocyanate and the photoconductive layer to comprise a compound with hydroxyl groups.

The aforementioned organic binders are outstandingly suitable for the protective covering layer 7 because of their homogeneous film formation and flexibility, their abrasion resistance and possible application methods. The influence of such layers on the photosensitivity of the recording material is negligibly small.

Thin applications of such protective covering layers are optically transparent. The preferred coherent layer produced on an organic photoconductor in a two-layer arrangement has a uniform thickness of about 0.5 to about 10 μm, preferably from about 0.5 to about 5.0 μm. Film surfaces are smooth, which is necessary for optimum cleaning. The adhesion between the covering layer and the photoconductor system is also sufficient to withstand mechanical stresses such as those due to the action of a cleaning brush. Compared with the photoconductor system to be coated, the abrasion resistance is markedly improved. It is important that the triboelectric behavior of the covering layer be the same as that of the photoconductor layer. At a storage temperature of 40°-50° C., the covering layer is not tacky, and there is also no migration of any component out of the photoconductor layer. The covering layer also serves to prevent crystallization effects which can be induced by contact with the photoconductor surface. The electrical conductivity of the covering layer is small enough that it does not affect the charging capacity of the photoconductor. On the other hand, the materials provide the covering layer with electrical permeability so that upon exposure to light, charges can leak away from the surface—down to a small residual voltage in some cases. The electrostatic charge image remains fully preserved after exposure until the image is developed, and this is necessary, since otherwise the resolution of the copy deteriorates. The specific electrical resistance is not altered by the moisture content of the surroundings. Finally, the film surface is free from hydrophilic components, so that the surface resistivity is not altered by climatic conditions.

The preferred systems for applying the coating are coating on a spreading machine for applying the coating to substrates such as photoconductor bands, preferably by continuous application, as well as spraying techniques, including if desired electrostatic techniques for applying the covering layer to substrates such as drums. Also, if drums are dip-coated, care must be taken as a restriction, that the photoconductor system is stable and will not dissolve during subsequent dip-coating with cover layer materials.

In a particular embodiment of the recording material according to the invention, additions of micronized organic or inorganic powders are dispersed in the photoconductive layer, whereby the adhesion-promotion and the abrasion properties are markedly improved.

In a further embodiment, photoconductive layers comprising, for example, hydroxyl group containing binders, particularly cellulose esters such as cellulose nitrates, are coated with a polyfunctional aromatic/aliphatic polyisocyanate or polyisocyanate prepolymer, and an adhesion-promoting, hardened transition zone is thus formed between the photoconductive layer and the covering layer.

The invention will be explained in greater detail with reference to the following non-limiting examples.

EXAMPLE 1

Solutions of an abrasion-resistant binder from the following Table I are applied, by continuous flow techniques and immediately thereafter dried for 5 minutes, onto two layer photoconductors which are built up, in the following order from an electrically conductive support comprising a 75 μm thick polyester film on which aluminum has been vapor deposited; a vapor-deposited layer of N,N'-dimethylperylimide (C. I. 71,129); and a charge-transport layer comprising 2,5-bis-(4-diethylaminophenyl)-1,3,4-oxadiazole (To) and highly viscous cellulose nitrate in a weight ratio of 65:35. The thicknesses of the individual protective covering layers with the different binders lie in the range of 2±0.5 μm. Both the photosensitivity and the abrasion resistance properties of the material with and without covering layer are tested under identical conditions. The results are summarized in the following Table I.

The measurement of the photosensitivity is carried out as follows. To determine the discharge curves in light, a test sample is moved on a rotating disk through a charging device to an exposure station, where it is continuously exposed with a xenon lamp. A heat-absorbing glass and a neutral filter having a transparency of 15% are placed in front of the xenon lamp. The light intensity in the plane of measurement lies in the range of 40–60 μW/cm², and is measured with an optometer immediately after the light discharge curve has been determined. The charge level ($U_o$) and the photo-induced decay curve in light are recorded oscillographically through a transparent probe via an electrometer. The photoconductor layer is characterized by the charge level ($U_o$) and the time ($T_{\frac{1}{2}}$), after which half the charge ($U_o/2$) is reached. The product of $T_{\frac{1}{2}}$ and the measured light intensity I (μW/cm²) is the half-value energy $E_{\frac{1}{2}}$ (μJ/cm²). The residual charge ($U_R$) after 0.1 second, determined from the above discharge curves in light, is a further measure of the discharge of the photoconductor layer.

To test the abrasion resistance properties, the abrasion of the various materials (photoconductor and cover layers) is measured on a standard abrasion test apparatus (Type 352 Taber Abraser) under the following conditions:

| | |
|---|---|
| Abrasive Material (friction rollers): | CS-10 F Calibrese |
| Loading: | 250 g |
| Abrasion area: | 26.3 cm² |
| Number of cycles: | 200 |

The abrasion in g/m² is determined by dividing the gravimetrically determined abrasion in mg by the abrasion area.

TABLE I

| Protective covering layer | Thickness g/m² | (—)$U_o$/V | $E_{\frac{1}{2}}$(μJ/cm²) | $U_R$/V after 0.1 second | Abrasion loss g/m² |
|---|---|---|---|---|---|
| None | 0 | 580 | 1.1 | 105 | 2.2–2.5 |
| Polyvinyl acetate dispersion in water | 1.6 | 480 | 1.2 | 105 | 1.6 |
| Polyurethane (crosslinking subsequently) 1.2 parts of polyisocyanate (75%), 1 part of polyester and 0.1%, relative to solids, of zinc octoate | 2.5 | 535 | 1.4 | 125 | ≦0.01 (drying for 30 minutes) |
| Aromatic, non-reactive linear polyurethane | 2–2.5 | 520 | 1.1 | 100 | 0.01 |
| Epoxide resin (reactive) Polyaminoamide adduct, Eurepox 716 epoxide resin 1:1 | 1.8 | 570 | 2.0 | 195 | 1.3 |
| Phenoxy resin | 2.0 | 555 | 1.2 | 125 | 0.2–0.05 |

EXAMPLE 2

A photoconductive system, as described in Example 1, but containing 50 parts by weight of To, 25 parts by weight of a polyester resin and 25 parts by weight of a polyvinyl chloride/polyvinyl acetate copolymer having a thickness of about 10 g/m², is coated with an aqueous polyacrylate dispersion (4% acrylate/styrene copolymer in $H_2O$) by continuous application in a single machine-coat. After drying, the thickness of this protective covering layer is about 0.5 μm. While the photosensitivity remains the same, the abrasion resistance is improved and the shelf-life is increased by the applied shiny layer.

The values in the following Table II are determined in the same manner as in Example 1:

TABLE II

| Covering layer | Thickness g/m² | (—)$U_o$/V | $E_{\frac{1}{2}}$(μJ/cm²) | $U_R$/V after 0.1 second | Abrasion loss g/m² |
|---|---|---|---|---|---|
| None | 0 | 750 | 3.5 | 225 | 2.1 |
| Polyacrylate | 0.4 | 750 | 3.3 | 205 | 1.6 |

EXAMPLE 3

The surface properties and photosensitivity of a photoconductive system produced according to Example 2 were tested in a dry toner copying apparatus. A magnetic brush device with a two-component toner mixture is used for development, and the layer is moved past a rotating brush for cleaning residual toner from the photoconductor surface. It is found thereby that the quality of the copies is the same under identical copying conditions with and without a covering layer. In a long-term copying test, strong surface films were apparent after 5,000 copies on the photoconductor layer without a protective covering layer, and the surface is duller. In contrast thereto, only insignificant surface films are discernible on the system provided with a covering layer, and the surface is still shiny.

EXAMPLE 4

To improve the abrasion resistance properties, 5% by weight, based on solids content, of micronized polyethylene wax (PE) or micronized polytetrafluoroethylene (PTFE) are dispersed into a charge-transport layer composed of 65 parts of To and 35 parts of cellulose nitrate. A dull, homogeneous photoconductor layer is obtained by subsequently coating the dispersion onto an aluminum/polyester support, on which N,N'-dimethylperylimide has been vapor deposited. The photosensitivity and abrasion are determined in accordance with the procedures of Example 1. Results are shown in the following Table III:

TABLE III

| Addition (5%) | Layer weight $g/m^2$ | $(-)U_o/V$ | $E_{\frac{1}{2}}(\mu J/cm^2)$ | $U_R/V$ after 0.1 second | Abrasion loss $g/m^2$ |
|---|---|---|---|---|---|
| None | about 8 | 530 | 1.8 | 55 | 2.2–2.5 |
| PTFE | 7.9 | 640 | 2.0 | 100 | 1.7 |
| PE | 7.7 | 650 | 1.9 | 110 | 1.3–1.6 |

EXAMPLE 5

An aqueous dispersion of self-crosslinking, heat-curable, pure acrylic resin is applied about 2 μm thick to the photoconductor layers described in Example 4, with and without the micronized powder addition, and the resulting covers are dried for about 10 minutes at 110° C. in a circulating air oven.

The homogeneous products are subjected to an abrasion test according to Example 1, and the results are:

| | |
|---|---|
| Photoconductor layer + covering layer | 0.95 $g/m^2$ |
| Photoconductor layer + PE + covering layer | 0.5 $g/m^2$ |

This shows that additions of a micronized powder, in particular in combination with covering layers, give a marked reduction in abrasion.

EXAMPLE 6

Various polycarbonate binders (I. Makrolon 2504 ®, Bayer AG; and II. Lexan 141 ®, General Electric) and a polysulfone (Polysulfone 1700 ® Union Carbide) show a very good abrasion resistance, when being whirler coated onto a 100 μm thick aluminum foil and dried for about 5 minutes at 110° C. The abrasion loss is determined according to the procedure of Example 1 to be:

| | |
|---|---|
| Polycarbonate I | 0.01 $g/m^2$ |
| Polycarbonate II | 0.01 $g/m^2$ |
| Polysulfone | 0.15 $g/m^2$ |

A solution of polycarbonate I in tetrahydrofuran is applied by continuous application machine coating about 2 μm thick onto a photoconductor layer as described in Example 1. After drying, an abrasion of 0.04 $g/m^2$ is measured.

The foregoing embodiments have been set forth as illustrations of the invention and are not intended to be limiting. Since modifications of the disclosed embodiments may occur to persons skilled in the art, the scope of the invention should be limited solely by the appended claims and equivalents.

I claim:

1. An electrophotographic recording material comprising an electrically conductive support, a photoconductive layer containing at least one organic charge carrier generating compound and at least one organic charge transporting compound, and a protective transparent covering layer having a thickness in the range from about 0.5 to about 10 μm and comprising a surface abrasion resistant subsequently crosslinkable material, said abrasion resistant material being a two-component system comprising a polyisocyanate selected from the group consisting of aliphatic polyisocyanates and aromatic polyisocyanates and a cross-linking, hydroxyl group containing compound selected from the group consisting of saturated polyesters, saturated polyethers, acrylic resins and epoxy resins.

2. An electrophotographic recording material comprising an electrically conductive support, a photoconductive layer containing at least one organic charge carrier generating compound and at least one organic charge transporting compound, and a protective transparent covering layer having a thickness in the range from about 0.5 to about 10 μm and comprising a surface abrasion resistant subsequently crosslinkable material, wherein the covering layer comprises a self-crosslinking polyisocyanate and the photoconductive layer comprises a compound containing hydroxyl groups.

3. A recording material according to claim 1 or 2, wherein a finely micronized powder is dispersed in the photoconductive layer.

4. A recording material according to claim 3, wherein the micronized powder is selected from the group consisting of polypropylene wax, polyethylene wax, polyamide wax, polytetrafluoroethylene powder, polyvinylidene fluoride powder, and micronized silica.

5. A recording material according to claim 1 or 2 further comprising an insulating interlayer interposed between said conductive support and said photoconductive layer.

6. A recording material according to claim 1 or 2, wherein said photoconductive layer further comprises an organic resin binder.

7. A recording material according to claim 1 or 2, wherein said photoconductive layer comprises two sublayers, one of said sublayers containing said charge carrier generating compound and the other of said sublayers containing said charge transporting compound.

* * * * *